US006755372B2

(12) United States Patent
Menzel et al.

(10) Patent No.: US 6,755,372 B2
(45) Date of Patent: Jun. 29, 2004

(54) AIR LAUNCH SYSTEM INTERFACE

(75) Inventors: Robert K. Menzel, Lake St. Louis, MO (US); James A. Simms, Florissant, MO (US); James V. Leonard, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/024,865

(22) Filed: Dec. 18, 2001

(65) Prior Publication Data

US 2003/0111574 A1 Jun. 19, 2003

(51) Int. Cl.[7] ..... F41G 7/00

(52) U.S. Cl. ..... 244/3.15; 244/3.11; 244/3.14; 244/3.19; 342/62

(58) Field of Search ..... 701/207, 213, 701/214–216, 200, 3; 342/357.01–357.17; 244/3.1, 3.11, 3.12, 3.22; 59/1.56

(56) References Cited

U.S. PATENT DOCUMENTS 3,856,237 A * 12/1974 Torian et al. ..... 244/3.11
5,429,322 A * 7/1995 Waymeyer ..... 244/3.15
5,435,503 A * 7/1995 Johnson et al. ..... 244/3.15
5,487,322 A * 1/1996 Rhodes ..... 89/1.56
5,541,839 A * 7/1996 Mitzkus et al. ..... 89/1.56
5,548,510 A * 8/1996 Ebert et al. ..... 701/200
5,931,874 A * 8/1999 Ebert et al. ..... 701/3
6,122,569 A * 9/2000 Ebert et al. ..... 701/3
6,349,898 B1 * 2/2002 Leonard et al. ..... 244/3.11

* cited by examiner

*Primary Examiner*—Bernarr E. Gregory
(74) *Attorney, Agent, or Firm*—Black Lowe & Graham PLLC

(57) ABSTRACT

An airborne missile launch system. The system includes a Harpoon aircraft command-launch control set (HACLCS) system, one or more Harpoon Block II missiles, and an interface controller coupled to the HACLCS system and the one or more Harpoon Block II missiles. The controller allows a user to create a missile profile mission. The controller combines the created missile profile mission with received positioning information. The missile(s) loads the combination into a navigation system of one of the Harpoon Block II missiles. The controller receives a mission-loaded signal upon completion of mission loading into one of the Harpoon Block II missiles, and converts the mission-loaded signal for interpretation by the HACLCS system.

6 Claims, 4 Drawing Sheets

AIR LAUNCH SYSTEM INTERFACE

FIELD OF THE INVENTION

This invention relates generally to missile systems and, more specifically, to airborne missile systems.

BACKGROUND OF THE INVENTION

Missile controlling software and hardware continues to evolve and improve the functionality of an associated missile. In an air-to-surface self-guided missile system improving the software associated with the system is merely a somewhat simple process of reconfiguring the software stored in the missile system of the airplane. However, if the change happens to be a hardware change, for example, replacing a Harpoon Block I Missile Package with a Harpoon Block II Missile Package, a software change to the on-board missile controls is not enough to support the hardware change.

In many cases, a new missile package requires a significant software upgrade that includes various graphical user interfaces for the creation of missions and the databases required in order to create those missions. In addition, other hardware may be required, such as a device for generating global positioning information. Therefore, simply swapping out one missile package for another missile package requires a plane to be out of commission for a significant period of time in order to implement all the associated changes that are required for the new missile package. Also, the time and cost required for performing this upgrade are quite extensive.

Therefore, there exists a need for a less expensive missile system upgrade that is easy to install into a fleet of aircraft.

SUMMARY OF THE INVENTION

The present invention is an airborne missile launch system that provides an improved missile upgrade system. The system includes a Harpoon aircraft command-launch control set (HACLCS) system, one or more Harpoon Block II missiles, and an interface controller coupled to the HACLCS system and the one or more Harpoon Block II missiles. The controller allows a user to create a missile profile mission. The controller combines the created missile profile mission with received positioning information. The controller loads the combination into a navigation system of one of the Harpoon Block II missiles. The controller receives a mission-loaded signal upon completion of mission loading into one of the Harpoon Block II missiles, and converts the mission-loaded signal for interpretation by the HACLCS system.

In accordance with further aspects of the invention, the HACLCS system generates a launch command when commanded by a flight crew member. The controller converts the launch command into Harpoon Block II format, and sends the converted launch command to the associated Harpoon Block II missile.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
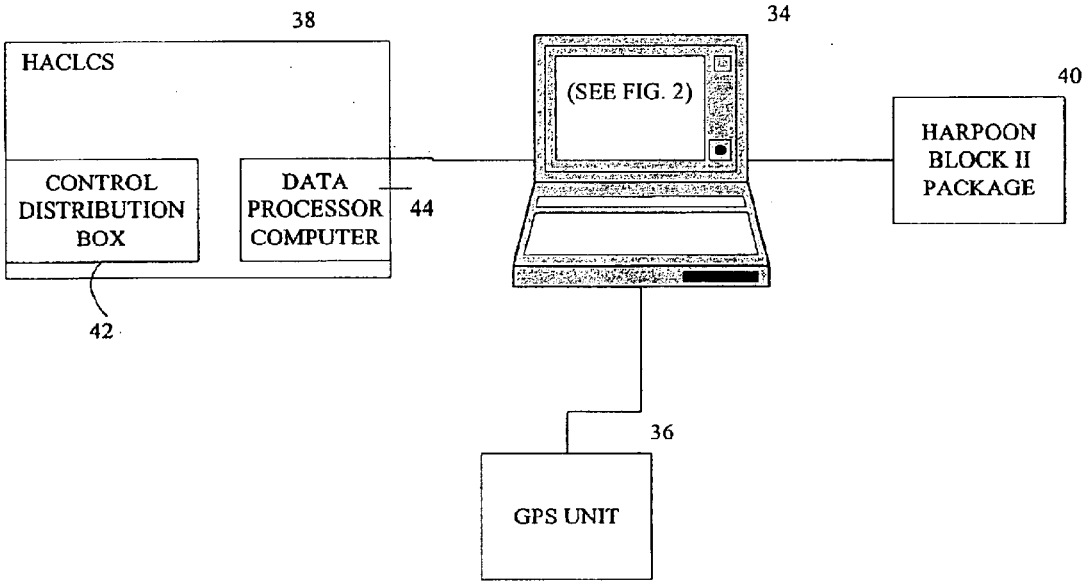
FIG. 1 is a block diagram of an example system for performing the process of the present invention.

The present invention provides an interface controller for allowing the incorporation of Harpoon Block II mission planning into a Harpoon Aircraft Command-Launch Control Set (HACLCS) system-equipped aircraft without any software modifications required to the already existing HACLCS system components within the aircraft. The system includes an interface controller 34 electronically coupled to the aircraft's HACLCS 38, a Harpoon Block II missile package 40, and a global positioning system (GPS) unit 36. The HACLCS 38 includes a number of components including a control distribution box 42 and a data processor computer 44. The connecting cables between the HACLCS 38 and the interface controller 34 include at least a pair of Mk-82 lines. A single Mk-82 line connects the interface controller 34 to the Harpoon Block II missile package 40. The interface controller 34 controls communications between the HACLCS 38 and the Harpoon Block II missile package 40. The components of the interface controller 34 and the process the controller 34 performs are illustrated in FIGS. 2 and 3 and described in more detail below.

Figure 2:
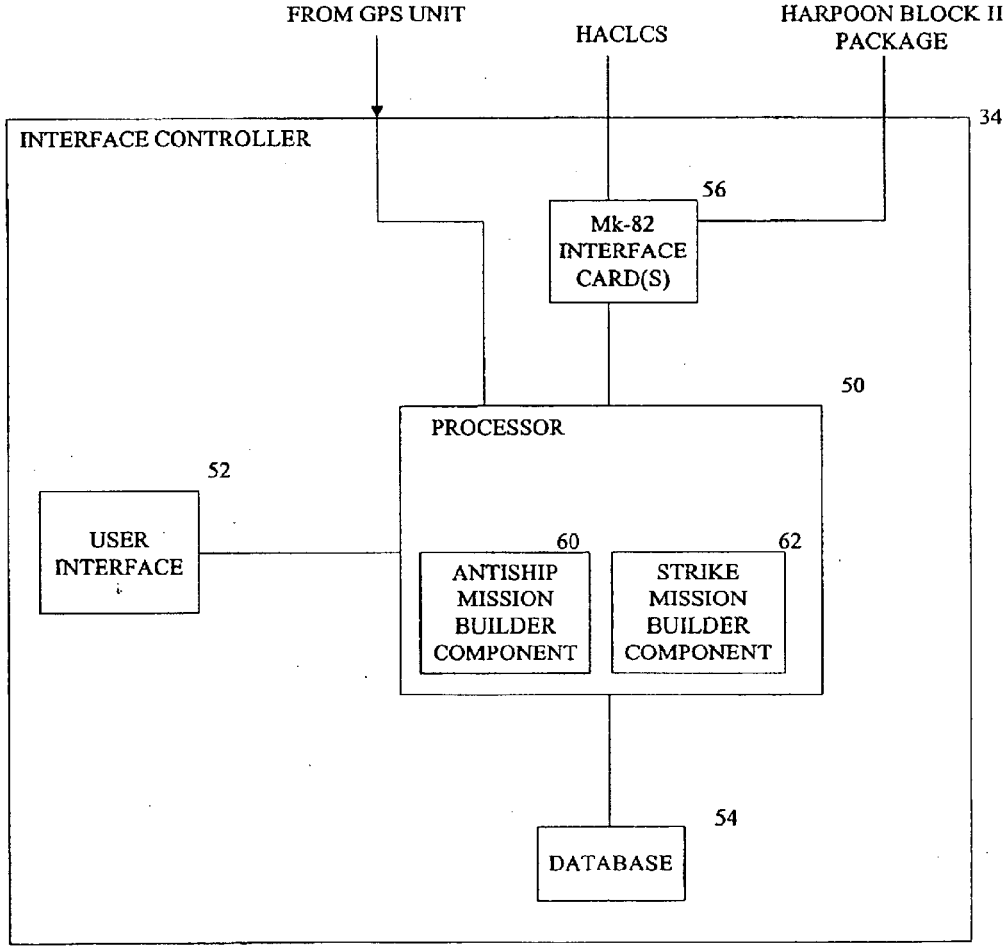
FIG. 2 is an illustration of the components of an interface controller formed in accordance with the present invention.
Figure 3:
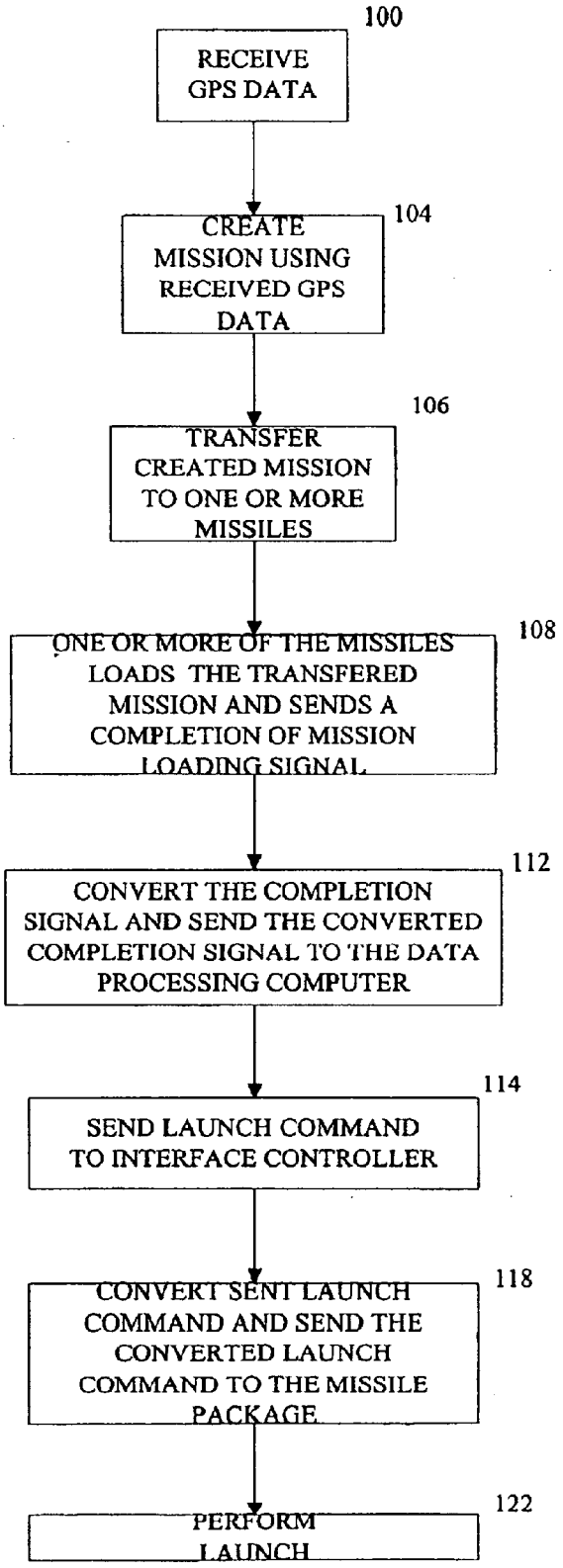
FIG. 3 is a flow diagram illustrating a process performed by the present invention.

FIG. 2 illustrates various components within the interface controller 34. The components are software components, hardware components, or a combination. The interface controller 34 includes a processor 50 that is electrically coupled to a user interface 52, a database 54, and one or more Mk-82 interface cards 56. The user interface 52 includes various user interface devices, such as a keyboard, a display, a microphone, speakers, and a cursor control device. The processor 50 runs various software components, such as an antiship mission builder component 60 or a strike mission builder component 62, that allow the user using the user interface 52 to create a mission specifically for loading into the navigation package of a Harpoon Block II missile. In other words, the builder components 60, 62 convert a user-planned route into unique data/datablocks required by the Block II missile in order to execute the mission. The processor 50 interfaces with the HACLCS 38 and the Harpoon Block II missile package 40 via one or more Mk-82 interface cards 56.

Harpoon Block II missiles are similar to Harpoon Block I missiles in that they provide status information, (i.e., missiles programmed and ready for launch). The status information of a Harpoon Block II missile is sent to the interface controller 34, whereby the processor 50 converts the status information into Harpoon Block I missile communications format. The Harpoon Block II status information that is Block I formatted is sent to the HACLCS 38. The HACLCS 38 can then interpret the Harpoon Block I missile and proceed as if a Harpoon Block I missile were being used. Any information sent by the HACLCS 38, such as launch instructions, that is destined for the Harpoon Block II missiles is sent via the Mk-82 lines to the processor 50 via one of the Mk-82 interface cards 56. The processor 50 then converts the received information from the HACLCS 38 into the format required by the Harpoon Block II missiles, and then sends the converted information to the Harpoon Block II missile package 40.

The software for performing the functions of the interface controller 34 can be implemented in an off-the-shelf laptop computer or other data processing device, such as a palm computer or a personal data assistant (PDA).

Figure 4:
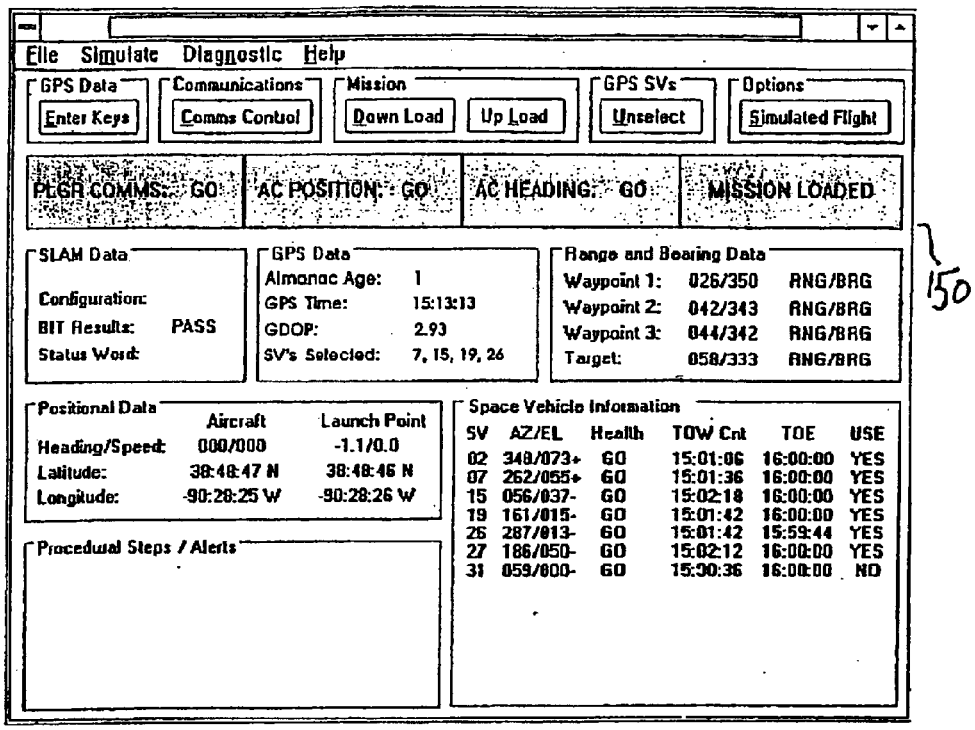
FIGS. 4 and 5 are graphical user interfaces implemented on the interface controller.
Figure 5:
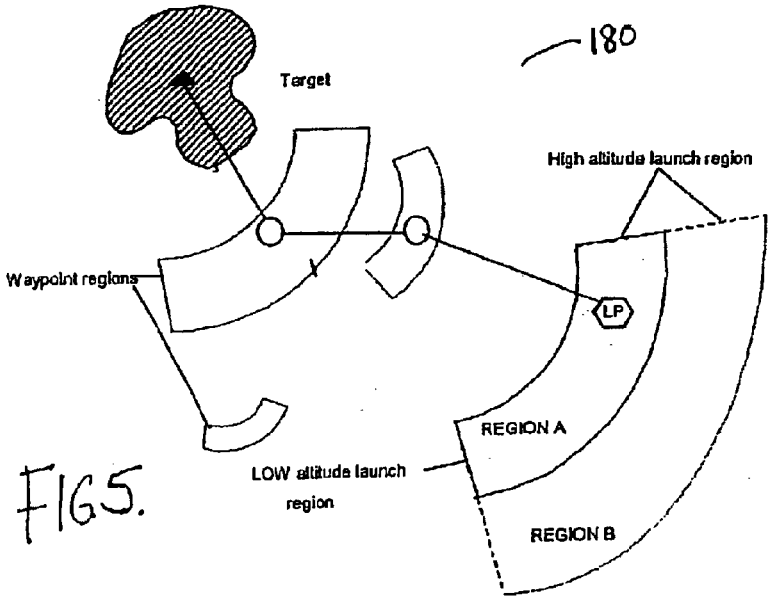

FIG. 3 illustrates an example of a method performed by the system shown in FIGS. 1 and 2. First, at block 100, the processor 50 receives GPS data from the GPS unit 36. Next, at block 104, a mission is created using the received GPS data. The GPS unit 36 provides satellite data (almanac, ephemeris, time/position) required by the Block II missile for guidance and navigation. The processor 50 formats the received satellite data to unique data/datablock requirements of the Block II missile. FIG. 4 is an example graphical user interface 150 showing missile control and GPS data. This is preferably done by an operator using the user interface 52, to interact with a graphical user interface generated by the mission builder components 60, 62 and presented on a display. The operator interacts with one of the mission builder components 60, 62 to define launch point latitude (lat)/longitude (long)/airspeed/altitude/heading, target point long/height, way point(s) lat/long/height, launch type antiship/strike, impact angles, and terminal maneuvers. The processor 50 combines the GPS data with the defined mission parameters to form a complete Block II mission. The built mission is stored in the database 54. FIG. 5 is an example graphical user interface 180 generated by the strike mission builder component 62.

At block 106, the created mission is transferred to one or more of the missiles in the Harpoon Block II missile package 40. The user interface 52 provides controls for downloading the completed mission from the processor 50 to the Block II missile via the Mk-82 interface card(s) 56. Then, at block 108, one or more operator-selected missiles loads the transferred mission and sends a completion of mission loading signal to the interface controller 34. The processor 50 converts the completion signal into a Block I format and sends the converted completion signal to the HACLCS 38, and more specifically the data processor computer 44 within the HACLCS 38, see block 112. At this point in the process, the HACLCS 38 notifies the flight crew that one or more of the missiles is mission loaded and ready for launch. Once a member of the flight crew initiates the launch at the HACLCS 38, a launch command is sent to the interface controller 34, see block 114. Next, at block 118, the processor 50 converts the sent launch command for interpretation by the Harpoon Block II missile to the associated Harpoon Block II missile. In launch sequence embodiment, the processor 50 acquires aircraft attitude data by simulating Block I communication with the HACLCS 38 via the Mk-82 interface cards 56. The processor 50 combines the GPS data, aircraft attitude data, and Block II mission data and downloads the mission to the Block II via MK-82 interface cards 56. The HACLCS 38 proceeds with the launch of the Block II missile because all of the simulated Block I responses via the MK-82 interface cards 56 meet HACLCS criteria for release. Once the missile receives the launch command, the launch of the missile is initiated, see block 122.

In one embodiment, the Mk-82 line that connects the interface controller 34 to the Harpoon Block II missile package 40 includes a medusa cable connector for coupling the Mk-82 line to an existing interconnect box of the Harpoon Block II missile package 40. The interconnect box couples to each of the Harpoon Block II missile stations. This allows the interface controller 34 to be easily installed and removed on an HACLCS 38 equipped aircraft, such as a P-3 Orion.

While the preferred embodiment of the invention has been illustrated and described, as noted above, many changes can be made without departing from the spirit and scope of the invention. For example, the order of the steps in the flow process can vary slightly without departing from the spirit and scope of the invention. Accordingly, the scope of the invention is not limited by the disclosure of the preferred embodiment. Instead, the invention should be determined entirely by reference to the claims that follow.

WHAT IS CLAIMED:

1. An airborne missile launch method comprising:

receiving positioning information;

creating a missile profile mission;

creating a mission in a first format by combining the created missile profile mission with the received positioning information;

loading the mission into a navigation system of a missile;

generating a mission-loaded signal upon completion of mission loading into the missile;

converting the generated mission-loaded signal to a second format for interpretation by an aircraft command-launch control set system; and presenting a flight crew with information that mission loading has been completed based on the received converted completion signal.

2. The method of claim 1, further comprising:

generating a launch command at the aircraft command-launch control set system;

converting the launch command into a form associated with the missile;

sending the converted launch command to the missile; and performing a launch of the missile based on the received converted launch command.

3. An airborne missile launch system including one or more missiles comprising:

an aircraft command-launch control set system arranged to process data in a first format; and an interface controller coupled to the aircraft command-launch control set system and the one or more missiles, the controller comprising:

a first component configured to create a missile profile mission;

a second component configured to create a mission in a second format for processing by the one or more missiles by combining the created missile profile mission with received positioning information;

a third component configured to send the mission to one of the missiles for loading;

a fourth component configured to receive a mission-loaded signal upon completion of mission loading into one of the missiles; and a fifth component configured to convert the generated mission-loaded signal from the first format to the second format for interpretation by the aircraft command-launch control set system.

4. The system of claim 3, wherein the aircraft command-launch control set system comprises a component configured to generate a launch command, and wherein the controller comprises:

a sixth component configured to convert the launch command into the first format; and a seventh component configured to send the converted launch command to the associated missile.

5. The system of claim 3, wherein the one or more missiles are Harpoon Block II missiles.

6. The system of claim 3, wherein the aircraft command-launch control set is a Harpoon aircraft command-launch control set.

* * * * *